United States Patent [19]

Soong

[11] 4,337,940

[45] Jul. 6, 1982

[54] JAVELIN

[76] Inventor: Tsai C. Soong, 1839 Jackson Rd., Penfield, N.Y. 14526

[21] Appl. No.: 207,448

[22] Filed: Nov. 17, 1980

Related U.S. Application Data

[63] Continuation-in-part of Ser. No. 199,941, Oct. 23, 1980, abandoned, Continuation-in-part of Ser. No. 760,163, Jan. 17, 1977, abandoned, Continuation-in-part of Ser. No. 655,462, Feb. 5, 1976, abandoned, Continuation-in-part of Ser. No. 529,792, Dec. 5, 1974, abandoned.

[51] Int. Cl.[3] ..... A63B 65/00

[52] U.S. Cl. ..... 272/106

[58] Field of Search ..... 272/106; 273/416

[56] References Cited

U.S. PATENT DOCUMENTS

| | | | |
|---|---|---|---|
| 1,569,395 | 1/1926 | Reach | 272/106 |
| 1,731,686 | 10/1929 | Rinneberg | 272/106 |
| 2,196,610 | 4/1940 | Schlademan et al. | 272/106 |
| 3,183,002 | 5/1965 | Updaw | 272/106 X |

FOREIGN PATENT DOCUMENTS

| | | | |
|---|---|---|---|
| 353118 | 5/1922 | Fed. Rep. of Germany | 272/106 |
| 475103 | 4/1929 | Fed. Rep. of Germany | 272/106 |
| 52388 | 11/1966 | Poland | 272/106 |

OTHER PUBLICATIONS

"Aircraft Basic Science", C. E. Chapel, Rev. Ed. 1948, pp. 15, 16 and 21.

"Physics of Bows & Arrows," P. E. Klopsteg, American Journal of Physics, Aug. 1943, pp. 189-192.

NASA Technical Report: TND 6996, L. H. Jorgensen, Jan. 1973.

"Arrow Stability: Dictionary of Guided Missiles and Space Flight," 1959, p. 54, Van Nostrand Co., Inc.

"Archery: The Technical Side," 1947, Hickman et al; pp. IV, V and 267.

Marks' Mechanical Engineers' Handbook, T. Baumeister, Sixth Ed., 1958, pp. 3-18.

"Modern Airmanship," N. D. Van Sickle, 4th Ed., 1971, p. 67.

*Primary Examiner*—Richard J. Apley

*Attorney, Agent, or Firm*—Stonebraker, Shepard & Stephens

[57] ABSTRACT

The aerodynamic center of pressure of a javelin is located preferably from 0 to 5 cm aft of the center of gravity at an angle of attack of relative wind of 90° to the axis of the javelin, and this is achieved by giving the javelin a proper surface shape and finish within present athletic competition rules for javelins. The javelin is also preferably marked with an indicia of the distance between the aerodynamic center of pressure and the center of gravity to inform the athlete of the javelin's flight characteristics to aid him in making the best possible throw.

5 Claims, 5 Drawing Figures

JAVELIN

RELATED APPLICATIONS

This application is a continuation-in-part of my parent application Ser. No. 199,941. The history of the related applications is as follows, each application being entitled JAVELIN and each predecessor application being abandoned upon the filing of the succeeding application:

| Sn. No. | Filed | |
|---|---|---|
| 529,792 | 12/05/74 | original |
| 655,462 | 2/05/76 | CIP |
| 760,163 | 1/17/77 | CIP |
| 199,941 | 10/23/80 | CIP |

BACKGROUND OF THE INVENTION

Present NCAA javelin rules specify many physical parameters of a javelin, but do not specify any location for the aerodynamic center of pressure (hereinafter referred to as c.p.); and so far as known to applicant, no one has aerodynamically analyzed a javelin's flight to determine its optimum aerodynamic characteristics.

I have found that the flight distance of a javelin is surprisingly affected by the distance between its center of gravity (hereinafter called c.g.) and its c.p. The c.p.-to-c.g. distance is hereinafter called the moment arm of the javelin, and javelins made to meet midrange requirements of the present NCAA rules have moment arms of about 20 cm or more. I have discovered that javelins with far smaller moment arms of from 0 to 5 cm can fly many meters farther than present javelins when launched at the same initial velocity. I have also found ways that the surface shape and finish relative to the weight distribution can be modified slightly within the present javelin rules to make javelins capable of significantly increased flight distances relative to launching velocity. The invention aims at a competition javelin meeting all the applicable rules, but made more aerodynamically efficient.

SUMMARY OF THE INVENTION

The inventive javelin meets athletic competition rules as to total weight, minimum and maximum dimensions, general shape, and head size and weight, and has a center of gravity located substantially forward of its longitudinal center. It has a surface shape and finish relative to its weight distribution effectively locating the aerodynamic c.p. preferably within 0–5 cm aft of its center of gravity at an angle of attack of relative wind of 90° to the axis of the javelin. Indicia of the moment arm distance between the c.p. and the c.g. or a function of this distance is marked on the javelin to aid the thrower in making the best possible throw, and a graduated and marked set of javelins differing in moment arm lengths is preferred.

DRAWINGS

DETAILED DESCRIPTION

Figure 1:
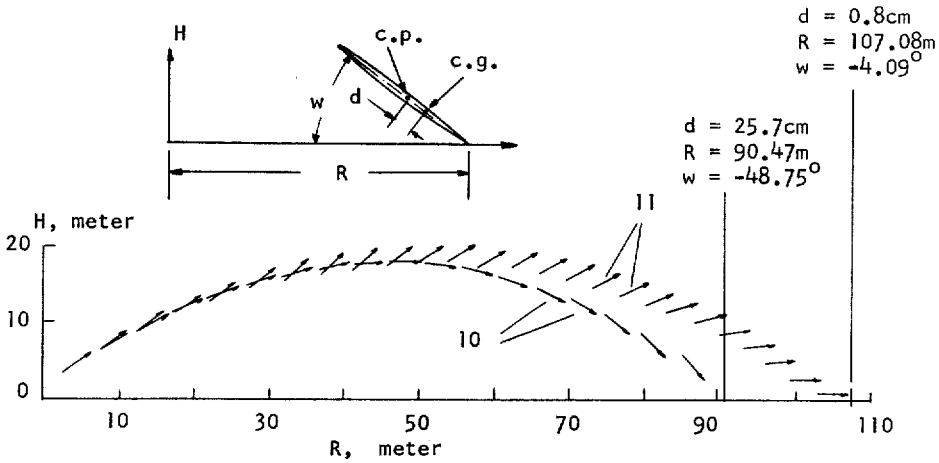
Figure 1 (PRIOR ART)
FIG. 1 is a schematic graph of the flight of the inventive javelin compared to the flight of a prior art javelin.

The official (NCAA) rules presently governing the physical parameters of a javelin are as follows:

| "RULE 34 - THE JAVELIN THROW |
|---|
| Measurement and Materials |
| Implement 1. The javelin shall consist of three parts, a metal head, a shaft, and a cord grip. The shaft may be constructed of either wood or metal and it shall have fixed to it a metal head terminating in a sharp point. |

TABLE VII

| JAVELIN MEASUREMENTS |
|---|
| Weight Inclusive of Cord Grip: |
| Minimum - 800 grams (1 pound, 12¼ ounces) |
| Overall Length: |
| Minimum - 260 centimeters (8 feet, 6⅜ inches) |
| Maximum - 270 centimeters (8 feet, 10¼ inches) |
| Length of Metal Head: |
| Minimum - 25 centimeters (9⅞ inches) |
| Maximum - 33 centimeters (12 31/32 inches) |
| Weight of Metal Head: |
| Minimum - 80 grams (2⅞ ounces) |
| Distance From Tip of Metal Head to Center of Gravity: |
| Minimum - 90 centimeters (2 feet, 11 7/16 inches) |
| Maximum - 110 centimeters (3 feet, 7¼ inches) |
| Diameter of Shaft at Thickest Point: |
| Minimum - 25 millimeters (1 inch) |
| Maximum - 30 millimeters (1.181 inches) |
| Width of Cord Grip: |
| Minimum - 15 centimeters (6 inches) |
| Maximum - 16 centimeters (6 5/16 inches) |
| 3. The cord shall be about the center of gravity without thongs, notches, or indentations of any kind on the shaft and shall not exceed the circumference of the shaft by more than 25 millimeters (1 inch). |
| 4. The cross section shall be regularly circular throughout and the maximum diameter thereof shall be under the grip. From the grip the javelin shall taper gradually to the tip of the metal head and the rear tip. The line from the end of the grip to the tip of the metal head may be straight or slightly curved but the curve must be gradual and there must be no abrupt alteration in the diameter of the section throughout the length of the javelin. |
| 5. The javelin shall have no mobile parts or other apparatus which during the throw could change its center of gravity or throwing characteristics. |
| 6. The tapering of the shaft from the maximum diameter to the tip of the metal head or to the rear tip shall be such that the diameter at the midpoint between the end of the cord grip and either tip shall not exceed 90% of the maximum diameter of the shaft, and that at the point 15 centimeters (6 inches) from either tip 80% of the maximum diameter." |

The rules also provide that the javelin must land tip first for the throw to be valid, but the rules do not presently require that the javelin land with its tip sticking into the ground or that it land at any particular angle, so long as it lands tip first. The rules do not specify the location of the aerodynamic center of pressure (c.p.) or the moment arm distance between the center of gravity (c.g.) and the c.p., probably because no one has appreciated the importance of a javelin's moment arm relative to its flight distance.

The javelin rules relative to the size and weight of the head and the permissible distance of the center of gravity aft from the tip of the head effectively locate the center of gravity substantially forward of the longitudinal center of the javelin. The relatively heavy head and c.g. spaced well forward of the longitudinal center for all competition javelins help achieve flying stability with the head leading the body in flight and help prevent tumbling in the air.

The aerodynamic c.p. depends on surface shape and finish of the javelin, and prior art javelins have been generally symmetrical, with similar forward and rearward shapes so that the c.p. is in the region of the longitudinal center of the javelin and substantially aft of the c.g. This gives prior art javelins substantial moment arms of 20 cm or more.

Figure 2:
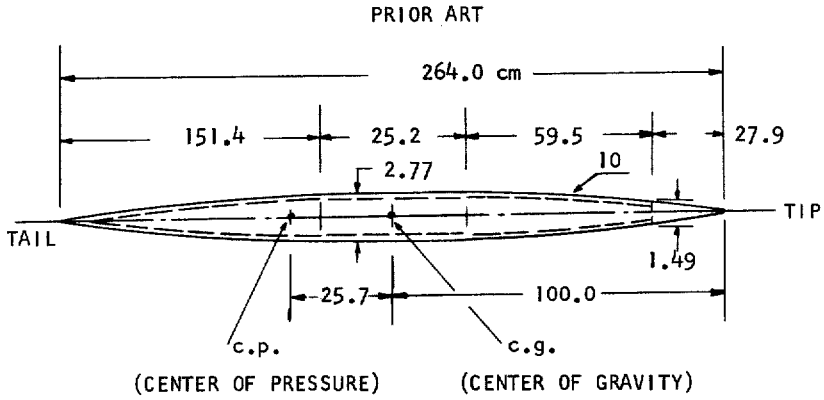
FIG. 2 is a partially cut away, elevational view of a typical prior art javelin.

After studying the aerodynamic flight of a javelin, I discovered that the moment arm of the javelin has a significant effect on its flight distance. To illustrate this, I have compared the representative prior art javelin of FIG. 2 having parameters falling within the midranges allowed by the NCAA rules and having a moment arm of 25.7 cm with the inventive javelin 11 having nearly the same parameters, except for having a moment arm of 0.8 cm. The calculated flight of the two javelins from the same launching velocity and angle is shown in FIG. 1. Based on the winning throw from the 1972 Olympic games, the prior art javelin 10 of FIG. 2 flew 90.47 m and landed at an angle of 48.75° from the horizontal; and the inventive javelin 11 having a moment arm of 0.8 cm has a calculated flight of 107.08 m and a landing angle of 4.09° from the horizontal. With the same launch velocity and angle for each javelin, the inventive javelin flies 16.61 m farther, by greatly reducing its moment arm.

Figure 3:
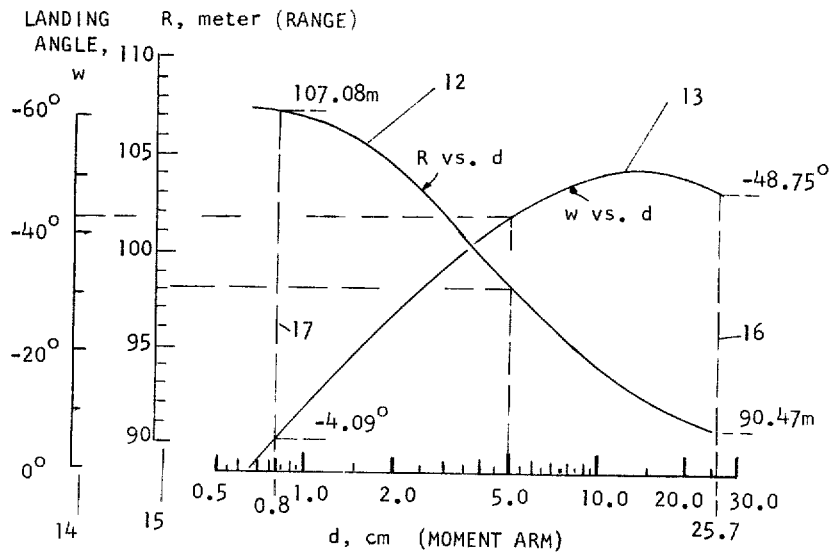
FIG. 3 is a graph of the flight distances and landing angles for javelins as affected by the moment arm of the javelin.

If the javelin is to land tip first, the c.p. must be aft of the c.g.; and if the moment arm is close to zero, the javelin lands very nearly horizontally. The low-moment-arm javelin that flies the farthest must be thrown at the proper angle to avoid landing tail first. FIG. 3 shows javelin flight distance versus moment arm on curve 12, and landing angle versus moment arm on curve 13. Scales 14 and 15 to the left of curves 12 and 13 are projected horizontally to read either landing angle or flight distance for various moment arms shown on curves 12 and 13. Thus, the prior art javelin study having a moment arm of 25.7 cm has its flight distance and landing angle shown along broken line 16, and the inventive javelin having a moment arm of 0.8 cm has its greater flight distance and lower landing angle shown along broken line 17. Curves 12 and 13 also show that javelins having moment arms from 0 to 5 cm achieve significantly greater distances from about 98 m to about 108 m for the same throw that sent the prior art javelin only 90.47 m. The landing angle for a javelin having a 5.0 cm moment arm is a little over 40°, and the landing angle decreases as the moment arm decreases.

Information about the moment arm of the javelin being thrown is important to the thrower, and some indicia of the moment arm or a performance-related function of the moment arm is marked on the javelin according to the invention. As athletes learn about the principles involved, they will tend to want to throw javelins having very small moment arms to achieve the greatest possible distance; but accurate launching angle to achieve a tip first landing angle becomes increasingly difficult. Also, if the NCAA rules are modified to require a minimum landing angle, the thrower still wants to have information about the moment arm of the javelin he is using so as to get the greatest possible distance with a valid landing angle. Strategy may be varied in making the three throws presently permitted with javelins of different moment arms in attempts to combine maximum flight distance with valid landing angle.

According to the invention, the preferred javelin has indicia of its actual moment arm or functionally related performance data marked on the javelin to be visible to the user. The marked indicia can be numeric or encoded as names, colors, or symbols and can represent varying ranges of moment arms.

As further background on my aerodynamic analysis of a javelin's flight, air resistance to the javelin's forward flight is centered upon the c.p. point in the axis of the javelin, but the javelin flies forward as if all its mass is centered on its c.g. In prior art javelins, the moment arm is approximately 20 cm or more so that the air resistance, in addition to slightly slowing down the forward speed of the javelin, also creates a pitching moment tending to pull the tip of the javelin downward. At the end of flight, the tip is pitched downward sufficiently for the javelin to land at an angle of between 20° and 45° between the javelin axis and the ground. When the moment arm is reduced according to the invention, the javelin is not pitched downward toward its tip so much and stays at its upwardly inclined posture longer than the conventional javelin. Then the air resistance keeps the javelin in the air longer like a bird riding the wind.

From single aerodynamic theory, it is known that if surface friction is disregarded, the c.p. in a direction perpendicular to the javelin's axis is approximately at the same point as the center of the projected area of the javelin in a plane containing the axis. Therefore, the c.p. position may be shifted by changing the diameters of the javelin along its axis. There are infinite ways of changing the javelin's diameters along its axis to achieve the desired moment arm of 0 to 5 cm, and FIG. 4 shows one way to achieve the proper shape for the inventive javelin.

Figure 4:
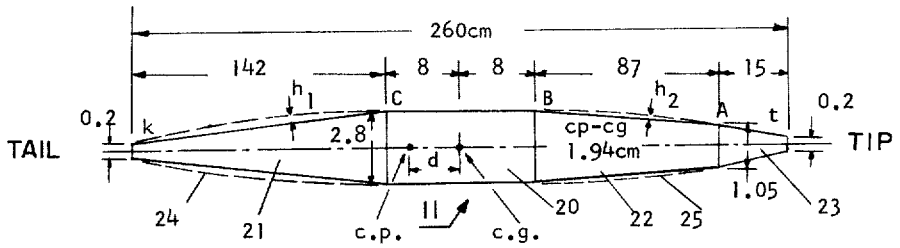
FIG. 4 is a partially cut away, side elevational view of a preferred way of shaping a javelin to have a moment arm as specified by the invention.

The solid-line javeline profile shown in FIG. 4 has a grip section 20, a trailing segment 22, and a head 23. All the segments 21–23 are generated by straight lines, and the c.g. is in the middle of the grip 20. Beginning with the solid-line base, the actual javelin surface shape for segments 22 and 21 can be formed as a circular arc 25 shown in broken lines from A to B and arc 24 shown in broken lines from C to K with the straight-line segments being cores having height $h_1$ for segment 21 and $h_2$ for segment 22 respectively to arcs 24 and 25. Then the moment arm or c.p.-to.c.g. distance "d" is approximately given by the following equation:

$$d = \frac{h_1 - 0.399h_2}{.0328 + .0127h_1 + .00766h_2}$$

Then for any desired value of moment arm "d", the aboe equation can be solved for numerical values for $h_1$ and $h_2$ to determine arcs 24 and 25 for the desired javelin shape. For example, if $h_2$ equals 0.2 cm and $h_1$ equals 0.15 cm, then "d" equals 1.94 cm within the moment arm range for the inventive javelin. Also, as shown in FIG. 4, the c.p.-to-c.g. value of 1.94 cm is marked on javelin 11. Generally, the application of this equation shows a basic error made in shaping prior art javelins with approximately uniform taper curvatures fore and aft, which produces a symmetrical appearance conforming with intuition, but which is erroneous because of a lack of appreciation of the effect of the moment arm in pitching the tip of the javelin downward during flight. The inventive javelin differs from prior art javelins by having a thicker or blunter shape forward of the grip and a thinner or more conical taper aft of the grip. It appears more blunt-nosed and thin-tailed to bring the c.p. forward, and it also includes a weight distribution moving the c.g. aft from its usual position toward the rearward limit of its permitted range.

A prior art javelin having the c.g. as far aft as permitted by the rules still has a much larger moment arm than is desirable according to the invention, because of the consistent practice of uniformly curved tapers for the forward and aft sections of prior art javelins. Without making clearly recognizable distinctions between the forward taper and the rearward taper, the c.p. cannot be brought within 0–5 cm of the c.g.

The inventive javelin is also shaped to bring the aerodynamic c.p. forward of the longitudinal center of the javelin. Even when the c.g. is moved as far aft as possible within the permissible rules, the c.p. must move forward of the longitudinal center to fall within the preferred range of 0 cm to 5 cm aft of the c.g.

Figure 5:
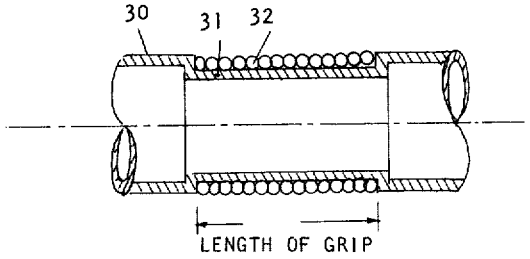
FIG. 5 is a fragmentary, cross-sectional view of an improved grip for the inventive javelin.

Prior art javelin 10 has a grip formed as a cord wound around and secured to the javelin shaft in the region of the center of gravity so that the cord extends outward around the maximum javeline diameter. This produces a little aerodynamic drag that can be reduced by recessing the cord into the javelin in the region of the grip as shown in FIG. 5. Javelin shaft 30 has a recess 31 of approximately the depth of the diameter of cord 32 so that the windings of cord 32 ar flush with javelin shaft 30. Modern javelins are made with hollow aluminum bodies, and the aluminum is preferably formed to provide recess 31 for cord 32 and is otherwise configured to meet the javelin rules and the requirements of the invention.

Those skilled in the art will appreciated the many ways that javelins can be made and configured to have a moment arm of from 0 to 5 cm for a longer flight distance as suggested by the invention, and precise results can be obtained from careful aerodynamic design checked by wind tunnel testing. The c.p.-to-c.g. moment arm distance is preferably markedeither directly or by some form of indicia on each javelin so that the users can pick javelins with moment arm best suited to their competition strategy.

Since the original application was filed, the Examiner questioned movement of the c.p. at different angles of attack; and this question was answered by a NASA technical report, NASA TND-6996, published in January 1973 by Dr. Leland H. Jorgensen, who is an aerodynamic research scientist, an associate Fellow of The American Institute of Aeronautics and Astronautics, and is employed by the NASA AMES research center at Moffet Field, Calif. Calculations from the NASA technicap report are already on file in a response to a previous office action.

The NASA technical report gives a more precise way of calculating the center of pressure for long, slender bodies; and the application of these calculations is shown in Table I for a prior art javelin having a c.p.-c.g. moment arm of 25.5 cm at an angle of attack of relative wind at 90° to the axis of the javelin and the inventive javelin having a c.p.-c.g. moment arm of 1.6 cm at an angle of attack of relative wind of 90° to the axis of the javelin. The moment coefficients are also set out in Table I for different angles of attack; and when the moment coefficients are applied relative to air density and relative velocity, they reveal the actual moment force tending to pitch the tip of the javelin downward during flight. As Table I shows, pitching moments are relatively small at small angles of attack.

Table I shows that the c.p. moves relatively little at angles of attack from 90° to 10° where moment coefficients are large enough to subject the javelin to moments affecting its flight. At 10° the moment coefficient is only 11% of the moment coefficient at 50° and is nearly insignificant. At an angle of attack of less than 10°, the c.p. moves farther; but because moment coefficients are so low at such angles, the effect is negligible and can be ignored.

Table I also shows the enormous difference in moment arms between the inventive javelin having a relatively thinly tapered tail section and a more bluntly tapered forward section and a prior art javelin having uniformly tapered forward and rearward sections. The comparison of moment coefficients between the inventive javelin and the prior art javelin also shows significant differences in flight effects from changes in the moment arm.

TABLE I

Effect of the Angle of Attack on $\bar{x}_o$ & $C_m$*

$\alpha$ = angle of attack, degree
$\bar{x}_o$ = distance of c.p. behind the c.g. (centimeter)
$C_m$ = moment coefficient, which when multiplied by $\frac{1}{2}\rho_{air}V^2_{air}$ becomes the moment on the javelin about c.g.

| Angle of attack $\alpha$ | $\bar{x}_o$, (cm) Inventive javelin | $\bar{x}_o$, (cm) Current javelin | $C_m$ Inventive javelin | $C_m$ Current javelin |
|---|---|---|---|---|
| 0° | 9.3 cm | 9.7 cm | 0 | 0 |
| 2° | 6.2 | 16.4 | 1.4 | 4.0 |
| 3° | 5.5 | 17.9 | 2.3 | 7.9 |
| 5° | 4.5 | 20.0 | 4.2 | 19.7 |
| 10° | 3.4 | 22.2 | 10.0 | 71.5 |
| 15° | 2.9 | 23.2 | 17.4 | 153.7 |
| 20° | 2.6 | 23.7 | 26.1 | 263.5 |
| 30° | 2.2 | 24.4 | 46.2 | 554.7 |
| 40° | 2.0 | 24.7 | 67.9 | 905 |
| 50° | 1.9 | 25.0 | 88.5 | 1280 |
| 60° | 1.8 | 25.2 | 106 | 1636 |
| 70° | 1.7 | 25.3 | 118 | 1908 |
| 80° | 1.7 | 25.4 | 124 | 2088 |
| 90° | 1.6 | 25.5 | 123 | 2148 |

*Equations are given in next page

Equations for the values of $\bar{x}_o$ and $C_m$ are given below; they are derived from Exhibit 1 to Applicant's Affidavit (filed during prosecution of a predecessor to this application) and the numerical values given in Exhibit 2 (also filed during prosecution of a predecessor to this application). For current art javelin:

$$\bar{x}_o = \frac{116.96 \sin 2\alpha \cos(\alpha/2) + 12962.8 \sin^2\alpha}{12.052 \sin 2\alpha \cos(\alpha/2) + 507.696 \sin^2\alpha} \quad (1)$$

$$C_m = (C_{n1} + C_{n2})\,\bar{x}_o \quad (2)$$

$$= \left(2\frac{A_b}{A}\sin 2\alpha\cos(\alpha/2) + \frac{C_{dn}}{A}\sin^2\alpha\,(\eta_1 A_{p1} + \eta_2 A_{p2})\right)\bar{x}_o$$

$$= (2\sin 2\alpha\cos(\alpha/2) + 84.2352\sin^2\alpha)\,\bar{x}_o$$

For the inventive javelin:

$$\bar{x}_o = \frac{112.22 \sin 2\alpha \cos(\alpha/2) + 738.86 \sin^2\alpha}{12.052 \sin 2\alpha \cos(\alpha/2) + 460.78 \sin^2\alpha} \quad (3)$$

$$C_m = (2 \sin 2\alpha \cos(\alpha/2) + 76.466 \sin^2\alpha)x_o \quad (4)$$

A 90°-angle of attack of relative wind is most convenient for determining the short moment arm of 0–5 cm according to the invention, and both wind-tunnel measurements and calculations are more precise at that angle. The c.p. moves a small amount for smaller angles of attack in the flight of the javelin through the air; but as shown in Table I, the differences from prior art javelins are significant throughout all angles of attack that result in a large enough moment coefficient to produce any substantial pitching moment.

Calculations based on the NASA technical report also show that prior art javelins with approximately uniform fore and aft tapers cannot bring the c.p.-c.g. moment arm within 0–5 cm at an angle of attack of relative wind at 90° by any weight distribution adjustment within the present NCAA Javelin Rules, and that prior art javelins with similar fore and aft tapers have c.p.-c.g. moment arms of about 20 cm or more at an angle of attack of relative wind of 90°.

Furthermore, makers and users of prior art javelins have apparently not been aware of the important effects of the c.p.-c.g. moment arm and have not indicated moment arm characteristics on javelins to inform users of the expected flight characteristics. Recognition of this important relationship according to the invention and marking an indicia of the c.p.-c.g. moment arm can cooperate to sharpen competition by contributing to awareness of flight characteristics allowing users who can accurately control throwing angles to achieve greater flight distances. No existing javelin has a purposely contoured profile to take advantage of the physical phenomenon of the moment arm to improve the flight distance within the permissible rules; and even if future rules are changed, an understanding of the effect of the moment arm and an indicia of the moment arm marked on the javelin still gives the user an advantage in being able to combine an optimum throwing angle with optimum flight characteristics.

Applicant has now devised a better way of implementing the invention to inform and train javelin throwers in its use. This is to provide the users with a graduated set of javelins differing in moment arm distances and marked with indicia of their moment arms so that the user can experience the differing flight characteristics of javelins having different moment arms and learn how to apply this information to his own throwing style.

For example, at the same launching angle, different launching velocities make different flight times possible; and for each launch velocity, a moment arm exists that will give maximum distance and a shallow landing angle. Some throwers cannot achieve a fast enough launching velocity to use javelins with the shortest moment arms, because the javelin flight times will not last long enough for their heads to pitch downward and land point first. A tail first landing is disqualified, so the thrower must be able to select the javelin with the moment arm that fits his throwing angle and velocity and produces a shallow landing angle after the longest possible flight.

Some throwers may require relatively large moment arms so that the heads of the javelins they throw pitch downward quickly enough to land head first after a relatively short flight. More skillful throwers who can achieve longer distances can use shorter moment arm javelins and increase their range even more. A thrower of any ability can do better by selecting a javelin with an appropriate moment arm to give a shallow landing angle, and choices among a graduated set of javelins having different moment arms are important to make this possible.

Javelins of a set graduated according to moment arm lengths could look indistinguishably alike and differ from each other only slightly in shape or weight distribution, but each would have indicia of its particular moment arm marked on its surface to be visible to the user. Such a set of javelins adds another dimension to the sport and greatly increases the variations possible compared to the present state of the sport with all javelins being essentially alike and having long moment arms of unknown lengths.

The javelins in a graduated set having moment arms of approximately 30 cm, 25 cm, 20 cm, 15 cm, 10 cm, 5 cm, and 2.5 cm, for example, allow experimentation, obvervation, and selection of javelins that are best for each thrower. Such a set also encourages a thrower to advance from longer moment arm javelins towards shorter moment arm javelins and provides some necessary information to make this possible.

Indicia of the moment arm marked on javelins can have many different forms and can be a function of the moment arm. Numerical indication of the actual moment arm distance and conversion of this information to colors, codes, names, etc. are only a few of many possibilities. The moment arm of a javelin affects its flight time and flight distance so that these become functions of the moment arm and can be marked on the javelin as indicia of the moment arm. For example, under the reasonable assumption that most throws are launched at about a 35° angle at differing velocities, moment arms can be selected that will give a shallow landing angle for each of several different ranges of flight times and distances. A lower velocity launch producing a shorter flight time and distance requires a longer moment arm for a head first landing at a shallow angle, and a longer flight time and distance requires a shorter moment arm for the same landing. By using these relationships, indicia of the javelin's moment arm can be marked as a function of flight time or distance.

By expressing moment arm as a function of flight time, a set of javelins could be graduated for 6 seconds, 5 seconds, 4 seconds, and 3 seconds, with the longer times representing shorter moment arms and the shorter times representing longer moment arms. Throws approximating these respective flight times would all have shallow landing angles and maximum distance.

A graduated set of javelins can also be marked with flight distances as a function of their moment arms, and this is probably the simplest indicia for the throwers. This could be done with javelins graduated in 10 meter intervals from 100 meters downward, with the longer distances representing the shorter moment arms and with moment arms increasing in length as the flight distances shorten so as to produce shallow landing angles for all distances. Javelin distances can also be indicated by codes or words such as long range, mid-range, and short range. With any such arrangement, the thrower can select a javelin marked with indicia that approximately matches his throwing distance to extend his range to the maximum and produce a shallow landing angle. Larger than necessary landing angles indicate that he should use a longer range javelin with a shorter moment arm to take advantage of the flight time and distance he is producing and extend his range to a maximum. Conversely, tail first landings indicate that he should switch to a longer moment arm javelin marked for a shorter distance range to insure that his throws qualify.

I claim:

1. A javelin meeting athletic competition rules as to total weight, minimum and maximum dimensions, general shape, and head size and weight, and with a forward direction proceeding toward a forward tip end of said javelin and an aft direction proceeding toward an aft tail end, said javelin having a center of gravity located substantially forward of its longitudinal center, and comprising:

a. said javelin having a surface shape and finish relative to its weight distribution effectively locating the aerodynamic center of pressure forward of said longitudinal center and within 0–5 cm aft of said center of gravity at an angle of attack of relative wind of 90° to the axis of said javelin; and b. indicia indicative of said distance between said aerodynamic center of pressure and said center of gravity as defined in paragraph a. being marked on said javelin.

2. A javelin meeting athletic competition rules as to total weight, minimum and maximum dimensions, general shape, and head size and weight, and with a forward direction proceeding toward a forward tip end of said javelin and an aft direction proceeding toward an aft tail end, said javelin having a center of gravity located substantially forward of its longitudinal center, and comprising:

a. said javelin having a surface shape and finish relative to its weight distribution so that at an angle of attack of relative wind of 90° to the axis of said javelin, the aerodynamic center of pressure of said javelin is located forward of said longitudinal center and within a predetermined moment arm distance aft of said center of gravity; and b. indicia indicative of said predetermined moment arm distance being marked on the surface of said javelin to be visible to the user and apprise the user of said moment arm distance as a significant flight characteristic of said javelin.

3. A graduated set of a plurality of the javelins of claim 2, said javelins in said set differing from each other in said surface shape and finish relative to weight distribution predetermined for each javelin to result in a different length of said predetermined moment arm distance for each javelin.

4. The javelin set of claim 3 wherein said indicia marked on said javelins is indicative of said moment arm distance for each javelin.

5. A javelin meeting athletic competition rules as to total weight, minimum and maximum dimensions, general shape, and head size and weight, and with a forward direction proceeding toward a forward tip end of said javelin and an aft direction proceeding toward an aft tail end, said javelin having a center of gravity located substantially forward of its longitudinal center, and said javelin having a surface shape and finish relative to its weight distribution so that at an angle of attack of relative wind of 90° to the axis of said javelin, the aerodynamic center of pressure of said javelin is located forward of said longitudinal center and within a predetermined moment arm distance of 0–5 cm aft of said center of gravity.

* * * * *